US005332639A

United States Patent [19]

Nakamura et al.

[11] Patent Number: 5,332,639

[45] Date of Patent: Jul. 26, 1994

[54] TONER FOR USE IN ELECTROPHOTOGRAPHY AND ITS MANUFACTURING PROCESS COMPRISING A CHARGE CONTROL ADDITIVE OF AN OXIDE COATED WITH A MIXTURE OF TIN OXIDE AND ANTIMONY

[75] Inventors: Tadashi Nakamura, Nara; Shougo Iwai, Yamatokoriyama, both of Japan

[73] Assignee: Sharp Kabushiki Kaisha, Osaka, Japan

[21] Appl. No.: 79,796

[22] Filed: Jan. 6, 1992

Related U.S. Application Data

[63] Continuation of Ser. No. 558,298, Jul. 26, 1990, abandoned.

[30] Foreign Application Priority Data

Aug. 8, 1989 [JP] Japan ..... 1-205164
Aug. 8, 1989 [JP] Japan ..... 1-205165
Aug. 8, 1989 [JP] Japan ..... 1-205166

[51] Int. Cl.[5] ..... G03G 9/00

[52] U.S. Cl. ..... 430/110; 430/111; 428/403; 428/404

[58] Field of Search ..... 430/110, 111, 106.6, 430/107; 428/403, 404

[56] References Cited

U.S. PATENT DOCUMENTS 4,514,485 4/1985 Ushiyama et al. ..... 430/106.6
4,803,144 2/1989 Hosoi ..... 430/110
4,828,951 5/1989 Kaneko et al. ..... 430/47

FOREIGN PATENT DOCUMENTS 3809217 9/1988 Fed. Rep. of Germany .
58-40557 3/1983 Japan .
58-68047 4/1983 Japan .
63-146048 6/1988 Japan .
63-200159 8/1988 Japan .
63-271469 11/1988 Japan .

*Primary Examiner*—Steve Rosasco
*Attorney, Agent, or Firm*—Birch, Stewart, Kolasch & Birch

[57] ABSTRACT

A toner for use in electrophotography in accordance with the present invention comprises toner particles and an external additive that is constituted by a silica fine powder composed of inexpensive silica particles coated with a mixture of homogeneously distributed tin oxide and antimony, and that is attached to the surface of the toner particles. The use of the silica fine powder improves the flowability of the toner whereby images with a uniform density can be obtained. In addition, the toner is stabilized as the above mixture lowers the electric resistance on the surface of the toner particles.

The above external additive may also be composed of aluminum oxide fine powder or cerium oxide fine powder. For instance, with a toner for use in electrophotography that comprises an external additive composed of cerium oxide fine powder, the surface of the photoreceptor is polished though the polishing action of the cerium oxide whereby the formation of a toner film on the photoreceptor can be prevented and clear images can be obtained.

26 Claims, No Drawings

TONER FOR USE IN ELECTROPHOTOGRAPHY AND ITS MANUFACTURING PROCESS COMPRISING A CHARGE CONTROL ADDITIVE OF AN OXIDE COATED WITH A MIXTURE OF TIN OXIDE AND ANTIMONY

This is a continuation of application Ser. No. 07/558,298 filed on Jul. 26, 1990, now abandoned.

FIELD OF THE INVENTION

The present invention relates to a developer for use in electrophotography and employed in electrophotographic apparatuses such as copying machines of the electrostatic image transfer type, laser printers, etc., and to its manufacturing process.

BACKGROUND OF THE INVENTION

In the conventional art, a toner for use in electrophotography (hereinafter referred to simply as toner) produced such as to eliminate the edge effect, i.e. the density of black solid areas in the images is thinner in the center than in the periphery, and such as to prevent the background of the images from being stained, is disclosed in Japanese Publication for Unexamined Patent Application (refer to for example Publication for Unexamined Patent Application No. 1983-40557, Tokukaisho No. 58-40557, and Publication for Unexamined Patent Application No. 1983-68047, Tokukaisho No. 58-68047). Such a toner is generally composed of toner particles produced by mixing, kneading, grinding and classifying different materials, and of an external additive attached on the surface of the toner particles. This external additive is composed of tin oxide or the like, has a conductivity control function and controls the electrostatic charge of the toner.

The toner particles, when used in a two-component developer composed of toner particles and carrier particles, comprise internal additives such as binder resins for holding the different materials composing the toner together, and for fixing colorants on transfer paper, colorants for imparting color to the toner, electrostatic charge control agents for giving an electrostatic charge to the toner, surface lubricants for preventing the toner to adhere to the heat roller of the electrophotographic apparatus, and other internal additives.

Meanwhile, the toner particles of a single-component developer that does not use carrier particles and where magnetism is given to the toner particles themselves, comprise internal additives such as binder resins, magnetic substances for imparting magnetism to the toner particles, colorants, and other internal additives.

However, when like in the conventional art, tin oxide is added on the surface of the toner particles, the flowability of the toner worsens and a bridge phenomenon (particles of toner are bond to each other) occurs thereby impeding a smooth supply of toner. The toner of the conventional art thus presents the disadvantage that fine images cannot be secured.

Besides, in common copying machines of the electrostatic image transfer type, especially copying machines that employ an organic optical semiconductor as photoreceptor, the surface of the photoreceptor deteriorates due to ozone produced by the electrostatic charger. This causes the toner to form a film on the photoreceptor, and thereby the image to become unclear and fuzzy.

SUMMARY OF THE INVENTION

An object of the present invention is to assure a smooth supply of toner by improving the flowability of the toner, and thereby to secure fine images.

Another object of the invention is to prevent that toner forms a film on a photoreceptor and to secure clear images.

In order to achieve the above objects, a toner for use in electrophotography in accordance with the present invention comprises toner particles and an external additive that is constituted by a fine powder composed of particles coated with a mixture of homogenously distributed tin oxide and antimony, and that is attached on the surface of the toner particles. The above mixture is used for controlling the electrostatic charge on the surface of the toner particles.

The external additive may be silica fine powder, aluminum oxide fine powder, or cerium oxide fine powder.

In the above constitution, the use of the fine powder composed of particles coated with the tin oxide and antimony mixture significantly enhances the flowability of the toner and thus enables a smooth supply of toner. As a result, fine images having a uniform density may be obtained.

In addition, when silica fine powder is employed as external additive, the inexpensive price of silica permits an efficient use of the conductivity of the costly tin oxide and antimony.

Further, when cerium oxide is employed as external additive, the surface of the photoreceptor is polished due to the polishing action of the cerium oxide. The formation of a film of toner on the photoreceptor is thus prevented and clear images are obtained.

The invention and its various advantages will become more apparent to those skilled in the art from the ensuing description

DESCRIPTION OF THE EMBODIMENTS

The invention will be described in details in the following examples and comparative examples.

EXAMPLE 1

Toner particles composing a toner for use electrophotography (herein after referred to simply as toner) of the present example comprise for example the following internal additives: binder resin, colorant, electrostatic charge controlling agent and wax as surface lubricant. Silica fine powder that is composed of silica particles coated with a mixture of tin oxide and antimony, is added externally on the surface of the toner particles.

The mixture of tin oxide and antimony should preferably be such that tin oxide and antimony are homogeneously distributed and such as to have a proper solid solution.

The mixing ratio of tin oxide : antimony should normally be equal to 100:3 to 100:20, and preferably equal to 100:5 to 100:15. The average particle size of the silica particles coated with tin oxide and antimony should normally be not more than 1 μm, preferably be equal to 0.005 μm to 0.5 μm. The optimum particle size is equal to 0.01 μm to 0.07 μm. The amount of the tin oxide and antimony mixture coated on the silica particles should normally be comprised within 20% by weight to 200% by weight, and preferably within 40% by weight to 170% by weight with respect to the silica fine powder. The optimum amount of the tin oxide and antimony mixture coated on the silica particles is equal to 60% by weight to 140% by weight with respect to the silica fine powder.

The specific electric resistivity of the silica fine powder composed of the silica particles coated with the tin oxide and antimony mixture, and produced as described above, is approximately equal to 10 Ωcm to $10^3$ Ωcm.

Styrene, styrene-acrylic, polystyrene, polyester, epoxy resins or other resins, may be employed as binder resin.

Known pigments and dyes such as carbon black, copper phthalocyanine blue, azo dye and the like, may be used as colorant.

Nigrosine dyes, quaternary ammonium salt, or the like may used as electrostatic charge control agent.

The wax employed may be low molecular weight polypropylene, low molecular weight polyethylene or the like.

The manufacturing process of a toner for use in electrophotography in accordance with the present example and having the above-mentioned constitution, will be described hereinbelow.

First, styrene-acrylic 87 parts by weight, carbon black 7 parts by weight, a nigrosine dye 4 parts by weight and low molecular weight polypropylene 2 parts by weight are melted and kneaded in a kneader, cooled and then undergo a grinding and classification process, thereby producing toner particles having an average particle size of 11 μm.

Then, silica fine powder is homogeneously mixed and added externally to the toner particles produced as described above, thereby producing a toner having a positive electrostatic charge. The above silica fine powder is composed of silica particles that are coated with a tin oxide and antimony mixture (where the ratio tin oxide:antimony is equal to 10:1), and that have an average particle size equal to 0.03 μm. The amount of silica fine powder is 1 part by weight with respect to 100 parts by weight of toner particles.

10000 images were formed consecutively using a two-component developer produced by mixing 6 parts by weight of a toner manufactured as described above, and a carrier composed of iron powder coated with silicon and having an average particle size of 95 μm. Fine images having no spot in the background and having a uniform density, were obtained.

EXAMPLE 2

Toner particles composing a toner for use in electrophotography in accordance with the present example comprise for example the following internal additives: binder resin, colorant, electrostatic charge controlling agent, wax and other agents. Silica fine powder that is composed of silica particles coated with a mixture of tin oxide and antimony, is added externally on the surface of the toner particles.

A manufacturing process of a toner for use in electrophotography in accordance to the present example and having the above-mentioned constitution, will be described hereinbelow.

First, styrene-acrylic 88 parts by weight, carbon black 6 parts by weight, quaternary ammonium salt 4 parts by weight, low molecular weight polypropylene 1 part by weight, and low molecular weight polyethylene 1 part by weight are melted and kneaded in a kneader, cooled and then undergo a grinding and classification process, thereby producing toner particles having an average particle size of 10 μm.

Then, silica fine powder is homogeneously mixed and added externally to the toner particles produced as described above and toner is produced. The above silica fine powder is composed of silica particles that are coated with a tin oxide and antimony mixture (where the ratio tin oxide:antimony equals 100:12), and that have an average particle size equal to 0.05 μm. The amount of silica fine powder is 1 part by weight with respect to 100 parts by weight of toner particles.

10000 images were formed consecutively using a two-component developer produced by mixing 6 parts by weight of a toner manufactured as described above, and 94 parts by weight of a carrier composed of ferrite coated with silicon and having an average particle size of 100 μm. Fine images having no spot in the background and having a uniform density, were obtained.

EXAMPLE 3

Toner particles composing a toner for use in electrophotography in accordance with the present example comprise, for example, the following internal additives: binder resin, magnetic substance, colorant, and other agents. Silica fine powder that is composed of silica particles coated with a mixture of tin oxide and antimony, is added externally on the surface of the toner particles.

In this case, a magnetic material such as magnetite or other material needs to be added as magnetic substance. The amount of the magnetic material is substantially equal to 25 parts by weight to 50 parts by weight with respect to 100 parts by weight of binder resin.

A manufacturing process of a toner used in electrophotography in accordance with the present example and having the above-mentioned constitution, will be described hereinbelow.

First, polyethylene 70 parts by weight, and magnetite 30 parts by weight are melted and kneaded in a kneader, cooled and then undergo a grinding and classification process, thereby producing magnetic toner particles having an average particle size equal to 12 μm.

Then, silica fine powder is homogeneously mixed and added externally to the toner particles produced as described above, thereby producing a single component magnetic toner. The above silica fine powder is composed of silica particles that are coated with a tin oxide and antimony mixture (where the ratio tin oxide:antimony equals 10:1), and that have an average particle size equal to 0.04 μm. The amount of silica powder is 1 part by weight with respect to 100 parts by weight of toner particles.

10000 images were consecutively formed using a developer composed of a toner produced as described above. Fine images having no spot in the background and having a uniform density, were obtained.

EXAMPLE 4

Toner particles composing a toner for use in electrophotography (herein after referred to simply as toner) of the present example comprise for example the following internal additives: binder resin, colorant, electrostatic charge controlling agent and wax as surface lubricant. Aluminum oxide fine powder that is composed of aluminum oxide particles coated with a mixture of tin oxide and antimony, is added externally on the surface of the toner particles.

The mixture of tin oxide and antimony should preferably be such that tin oxide and antimony are homogeneously distributed and such as to have a proper solid solution.

The mixing ratio of tin oxide:antimony should normally be equal to 100:3 to 100:20, and preferably equal to 100:5 to 100:15. The average particle size of the aluminum oxide particles coated with tin oxide and antimony should normally be not more than 1 μm, preferably be equal to 0.005 μm to 0.5 μm. The optimum particle size is equal to 0.01 μm to 0.07 μm. The amount of the tin oxide and antimony mixture coated on the aluminum oxide particles should normally be comprised within 20% by weight to 200% by weight, and preferably within 40% by weight to 170% by weight with respect to the aluminum oxide fine powder. The optimum amount of the tin oxide and antimony mixture coated on the aluminum oxide particles is equal to 60% by weight to 140% by weight with respect to the aluminum oxide fine powder.

Styrene, styrene-acrylic, polystyrene, polyester, epoxy resins or other resins, may be employed as binder resin.

Known pigments and dyes such as carbon black, copper phthalocyanine blue, azo dye and the like, may be used as colorant.

Nigrosine dyes, quaternary ammonium salt, or the like may used as electrostatic charge control agent.

The wax employed may be low molecular weight polypropylene, low molecular weight polyethylene or the like.

The manufacturing process of the toner having the above-mentioned constitution, will be described hereinbelow.

First, styrene-acrylic 87 parts by weight, carbon black 7 parts by weight, a nigrosine dye 4 parts by weight and low molecular weight polypropylene 2 parts by weight are melted and kneaded in a kneader, cooled and then undergo a grinding and classification process, thereby producing toner particles having an average particle size of 11 μm.

Then, aluminum oxide fine powder is homogeneously mixed and added externally to the toner particles produced as described above, thereby producing a toner having a positive electrostatic charge. The above aluminum oxide fine powder is composed of aluminum oxide particles that are coated with a tin oxide and antimony mixture (where the ratio tin oxide:antimony is equal to 10:1), and that have an average particle size equal to 0.03 μm. The amount of aluminum oxide fine powder is 1 part by weight with respect to 100 parts by weight of toner particles.

10000 images were formed consecutively using a two-component developer produced by mixing 6 parts by weight of a toner manufactured as described above, and a carrier composed of iron powder coated with silicon and having an average particle size of 95 μm. Fine images having no spot in the background and having a uniform density, were obtained.

EXAMPLE 5

Toner particles composing a toner in accordance with the present example comprise for example the following internal additives: binder resin, colorant, electrostatic charge controlling agent, wax and other agents. Aluminum oxide fine powder that is composed of aluminum oxide particles coated with a mixture of tin oxide and antimony, is added on the surface of the toner particles.

A manufacturing process of the toner having the above-mentioned constitution, will be described hereinbelow.

First, styrene-acrylic 88 parts by weight, carbon black 6 parts by weight, quaternary ammonium salt 4 parts by weight, low molecular weight polypropylene 1 part by weight, and low molecular weight polyethylene 1 part by weight are melted and kneaded in a kneader, cooled and then undergo a grinding and classification process, thereby producing toner particles having an average particle size of 10 μm.

Then, aluminum oxide fine powder is homogeneously mixed and added externally to the toner particles produced as described above and toner is produced. The above aluminum oxide fine powder is composed of aluminum oxide particles that are coated with a tin oxide and antimony mixture (where the ratio tin oxide:antimony equals 100:12), and that have an average particle size equal to 0.05 μm. The amount of aluminum oxide fine powder is 1 part by weight with respect to 100 parts by weight of toner particles.

10000 images were formed consecutively using a two-component developer produced by mixing 6 parts by weight of a toner manufactured as described above, and 94 parts by weight of a carrier composed of ferrite coated with silicon and having an average particle size of 100 μm. Fine images having no spot in the background and having a uniform density, were obtained.

EXAMPLE 6

Toner particles composing a toner in accordance with the present example comprise, for example, the following internal additives: binder resin, magnetic substance, colorant, and other agents. Aluminum oxide fine powder that is composed of aluminum oxide particles coated with a mixture of tin oxide and antimony, is added externally on the surface of the toner particles.

In this case, a magnetic material such as magnetite or other material needs to be added as magnetic substance. The amount of the magnetic material is substantially equal to 25 parts by weight to 50 parts by weight with respect to 100 parts by weight of binder resin.

A manufacturing process of the toner having the above-mentioned constitution, will be described hereinbelow.

First, polyethylene 70 parts by weight, and magnetite 30 parts by weight are melted and kneaded in a kneader, cooled and then undergo a grinding and classification process, thereby producing magnetic toner particles having an average particle size equal to 12 μm.

Then, aluminum oxide fine powder is homogeneously mixed and added externally to the toner particles produced as described above, thereby producing a single component magnetic toner. The above aluminum oxide fine powder is composed of aluminum oxide particles that are coated with a tin oxide and antimony mixture (where the ratio tin oxide:antimony equals 10:1), and that have an average particle size equal to 0.04 μm. The amount of aluminum oxide powder is 1 part by weight with respect to 100 parts by weight of toner particles.

10000 images were consecutively formed using a developer composed of a toner fabricated as described above. Fine images having no spot in the background and having a uniform density, were obtained.

EXAMPLE 7

Toner particles composing a toner for use in electrophotography (herein after referred to simply as toner)

of the present example comprise for example the following internal additives: binder resin, colorant, electrostatic charge controlling agent and wax as surface lubricant. Cerium oxide fine powder that is composed of cerium oxide particles coated with a mixture of tin oxide and antimony, is added externally on the surface of the toner particles.

The mixture of tin oxide and antimony should preferably be such that tin oxide and antimony are homogeneously distributed and such as to have a proper solid solution.

The mixing ratio of tin oxide : antimony should normally be equal to 100:3 to 100:20, and preferably equal to 100:5 to 100:15. The average particle size of the cerium oxide particles coated with tin oxide and antimony should normally be not more than 1 μm, preferably be equal to 0.005 μm to 0.5 μm. The optimum particle size is equal to 0.01 μm to 0.07 μm. The amount of the tin oxide and antimony mixture coated on the cerium oxide particles should normally be comprised within 20% by weight to 200% by weight, and preferably within 40% by weight to 170% by weight with respect to the cerium oxide fine powder. The optimum amount of the tin oxide and antimony mixture coated on the cerium oxide particles is equal to 60% by weight to 140% by weight with respect to the cerium oxide fine powder.

Styrene, styrene-acrylic, polystyrene, polyester, epoxy resins or other resins, may be employed as binder resin.

Known pigments and dyes such as carbon black, copper phthalocyanine blue, azo dye and the like, may be used as colorant.

Nigrosine dyes, quaternary ammonium salt, or the like may used as electrostatic charge control agent.

The wax employed may be low molecular weight polypropylene, low molecular weight polyethylene or the like.

The manufacturing process of the toner having the above-mentioned constitution, will be described hereinbelow.

First, styrene-acrylic 87 parts by weight, carbon black 7 parts by weight, a nigrosine dye 4 parts by weight and low molecular weight polypropylene 2 parts by weight are melted and kneaded in a kneader, cooled and then undergo a grinding and classification process, thereby producing toner particles having an average particle size of 11 μm.

Then, cerium oxide fine powder and hydrophobic silica having an average particle size of 0.015 μm are homogeneously mixed and added externally to the toner particles produced as described above, thereby producing a toner having a positive electrostatic charge. The above cerium oxide fine powder is composed of cerium oxide particles that are coated with a tin oxide and antimony mixture (where the ratio tin oxide:antimony is equal to 10:1), and that have an average particle size equal to 0.03 μm. The amount of cerium oxide fine powder is 1 part by weight and the amount of hydrophobic silica is 1 part by weight with respect to 100 parts by weight of toner particles.

10000 images were formed consecutively using a two-component developer produced by mixing 6 parts by weight of a toner manufactured as described above, and a carrier composed of iron powder coated with silicon and having an average particle size of 95 μm. Fine images having no spot in the background and having a uniform density, were obtained.

EXAMPLE 8

Toner particles composing a toner in accordance with the present example comprise for example the following internal additives: binder resin, colorant, electrostatic charge controlling agent, wax and other agents. Cerium oxide fine powder that is composed of cerium oxide particles coated with a mixture of tin oxide and antimony, is added on the surface of the toner particles.

A manufacturing process of the toner having the above-mentioned constitution, will be described hereinbelow.

First, styrene-acrylic 88 parts by weight, carbon black 6 parts by weight, quaternary ammonium salt 4 parts by weight, low molecular weight polypropylene 1 part by weight, and low molecular weight polyethylene 1 part by weight are melted and kneaded in a kneader, cooled and then undergo a grinding and classification process, thereby producing toner particles having an average particle size of 10 μm.

Then, cerium oxide fine powder and hydrophobic silica having an average particle size of 0.015 μm are homogeneously mixed and added externally to the toner particles produced as described above and toner is produced. The above cerium oxide fine powder is composed of cerium oxide particles that are coated with a tin oxide and antimony mixture (where the ratio tin oxide:antimony equals 100:12), and that have an average particle size equal to 0.05 μm. The amount of cerium oxide fine powder is 1 part by weight and the amount of hydrophobic silica is 1 part by weight with respect to 100 parts by weight of toner particles.

10000 images were formed consecutively using a two-component developer produced by mixing 6 parts by weight of a toner manufactured as described above, and 94 parts by weight of a carrier composed of ferrite coated with silicon and having an average particle size of 100 μm. Fine images having no spot in the background and having a uniform density, were obtained.

EXAMPLE 9

Toner particles composing a toner in accordance with the present example comprise, for example, the following internal additives: binder resin, magnetic substance, colorant, and other agents. Cerium oxide fine powder that is composed of cerium oxide particles coated with a mixture of tin oxide and antimony, is added externally on the surface of the toner particles.

In this case, a magnetic material such as magnetite or other material needs to be added as magnetic substance. The amount of the magnetic material is approximately equal to 25 parts by weight to 50 parts by weight with respect to 100 parts by weight of binder resin.

A manufacturing process of the toner having the above-mentioned constitution, will be described hereinbelow.

First, polyethylene 70 parts by weight, and magnetite 30 parts by weight are melted and kneaded in a kneader, cooled and then undergo a grinding and classification process, thereby producing magnetic toner particles having an average particle size equal to 12 μm.

Then, cerium oxide fine powder and titanium oxide fine powder are homogeneously mixed and added externally to the toner particles produced as described above, thereby producing a single component magnetic toner. The above cerium oxide fine powder is composed of cerium oxide particles that are coated with a tin oxide and antimony mixture (where the ratio tin oxide:antimony equals 10:1), and that have an average particle size equal to 0.04 μm. The amount of cerium oxide powder is 1 part by weight and the amount of titanium oxide fine powder is 1 part by weight with respect to 100 parts by weight of toner particles.

10000 images were consecutively formed using a developer composed of a toner fabricated as described above. Fine images having no spot in the background and having a uniform density, were obtained.

COMPARATIVE EXAMPLE 1

A two-component developer was produced with a toner to which particles, the silica fine powder of the example 1 that is composed of silica particles coated with a mixture of tin oxide and antimony, is not added.

10000 images were formed consecutively using the above developer. Spots were found in the background of the images, and the density of the images was irregular.

COMPARATIVE EXAMPLE 2

A two-component developer was produced with a toner to which particles, the aluminum oxide fine powder of the example 4 that is composed of aluminum oxide particles coated with a mixture of tin oxide and antimony, is not added.

10000 images were formed consecutively using the above developer. Spots were found in the background of the images, and the density of the images was irregular.

COMPARATIVE EXAMPLE 3

A two-component developer was produced with a toner to which particles, the cerium oxide fine powder of the example 7 that is composed of cerium oxide particles coated with a mixture of tin oxide and antimony, is not added.

10000 images were formed consecutively using the above developer. Spots were found in the background of the images, the density of the images was irregular, and images were unclear.

A toner for use in electrophotography in accordance with the present invention comprises an external additive that controls the electrostatic charge thereof, and that is constituted by silica fine powder composed of silica particles coated with a mixture of tin oxide and antimony.

As a result, the electric resistance lowers due to the conductive external additive (from, for example 10 Ωcm to $10^3$ Ωcm) and the toner is stabilized. The edge effect that occurs in black solid areas of the images is thus eliminated and the background of the image stays unstained. In addition, the use of the silica fine powder composed of silica particles coated with tin oxide and antimony, significantly improves the flowability of the toner and thereby enables a smooth supply of toner. Fine images having a uniform density may be thus obtained with an electrophotographic apparatus. Moreover, silica particles are used as core material for the external additive, and the inexpensive price of silica permits an efficient use of the conductivity of the costly tin oxide and antimony.

Aluminum oxide fine powder, or cerium oxide fine powder may be used instead of the above silica fine powder. When cerium oxide particles are used as core material for the external additive, the surface of the photoreceptor is polished due to the polishing action of the cerium oxide. The formation of a film of toner on the photoreceptor can be thus prevented with certainty and fine and clear images can be obtained.

The invention being thus described, it will be obvious that the same may be varied in many ways. Such variations are not to be regarded as a departure from the scope of the invention.

There are described above novel features which the skilled man will appreciate give rise to advantages. These are each independent aspects of the invention to be covered by the present application, irrespective of whether or not they are included within the scope of the following claims.

What is claimed is:

1. A toner for use in electrophotography comprising: toner particles, and an external additive which comprises a fine powder composed of coated particles wherein said particles are selected from the group consisting of silica, aluminum oxide, and cerium oxide, and wherein said coating on said particles comprises a mixture of homogeneously distributed tin oxide and antimony for controlling the electrostatic charge of said toner, wherein said external additive is attached on the surface of said toner particles.

2. A toner for use in electrophotography as defined in claim 1, wherein the mixing ratio of said coating mixture of tin oxide and antimony is equal to 100:3 to 100:20, and wherein the particles are silica particles and the average particle size of said silica particles is equal to 0.005 μm to 0.5 μm.

3. A toner for use in electrophotography as defined in claim 2, wherein the amount of said coating mixture on said silica particles is equal to 20% by weight to 200% by weight with respect to said silica particles.

4. A toner for use in electrophotography as defined in claim 3, wherein the specific electric resistivity of said silica particles is equal to 10 Ωcm to $10^3$ Ωcm.

5. A toner for use in electrophotography as defined in claim 2, wherein the amount of said coating mixture on said silica particles is equal to 40% by weight to 170% by weight with respect to said silica particles.

6. A toner for use in electrophotography as defined in claim 2, wherein the amount of said coating mixture on said silica particles is equal to 60% by weight to 140% by weight with respect to said silica particles.

7. A toner for use in electrophotography as defined in claim 1, wherein the mixing ratio of said coating mixture of tin oxide and antimony is equal to 100:5 to 100:15, and wherein the particles are silica particles and the average particle size of said silica particles is equal to 0.01 μm to 0.07 μm.

8. A toner for use in electrophotography as defined in claim 1, wherein the mixing ratio of said coating mixture of tin oxide and antimony is equal to 100:5 to 100:15, and wherein said particles are aluminum oxide particles and the average particle size of said aluminum oxide particles is equal to 0.005 μm to 0.5 μm.

9. A toner for use in electrophotography as defined in claim 8, wherein the amount of said coating mixture on said aluminum oxide particles is equal to 20% by weight to 200% by weight with respect to said aluminum oxide particles.

10. A toner for use in electrophotography as defined in claim 8, wherein the amount of said coating mixture on said aluminum oxide particles is equal to 40% by weight to 170% by weight with respect to said aluminum oxide particles.

11. A toner for use in electrophotography as defined in claim 8, wherein the amount of said coating mixture on said aluminum oxide particles is equal to 60% by weight to 140% by weight with respect to said aluminum oxide particles.

12. A toner for use in electrophotography as defined in claim 1, wherein the mixing ratio of said coating mixture of tin oxide and antimony is equal to 100:5 to 100:15, and wherein said particles are aluminum oxide particles and the average particle size of said aluminum oxide particles is equal to 0.01 μm to 0.07 μm.

13. A toner for use in electrophotography as defined in claim 1, wherein the mixing ratio of said coating mixture of tin oxide and antimony is equal to 100:3 to 100:20, and wherein said particles are cerium oxide particles and the average particle size of said cerium oxide particles is equal to 0.005 μm to 0.5 μm.

14. A toner for use in electrophotography as defined in claim 13, wherein the amount of said coating mixture on said cerium oxide particles is equal to 20% by weight to 200% by weight with respect to said cerium oxide particles.

15. A toner for use in electrophotography as defined in claim 13, wherein the amount of said coating mixture on said cerium oxide particles is equal to 40% by weight to 170% by weight with respect to said cerium oxide particles.

16. A toner for use in electrophotography as defined in claim 13, wherein the amount of said coating mixture on said cerium oxide particles is equal to 60% by weight to 140% by weight with respect to said cerium oxide particles.

17. A toner for use in electrophotography as defined in claim 1, wherein the mixing ratio of said coating mixture of tin oxide and antimony is equal to 100:5 to 100:15, and wherein said particles are cerium oxide particles and the average particle size of said cerium oxide particles is equal to 0.01 μm to 0.7 μm.

18. A toner for use in electrophotography comprising:

toner particles which comprise blinder resin and a magnetic material; and an external additive which comprises coated particles wherein said particles are selected from the group consisting of silica, aluminum oxide and cerium oxide, and wherein said coating on said particles comprises a mixture of homogeneously distributed tin oxide and antimony, wherein said external additive is attached on the surface of said toner particles, and wherein said magnetic material imparts magnetism to said toner, and the amount of said magnetic material is equal to 25 parts by weight to 50 parts by weight with respect to 100 parts by weight of said binder resin.

19. A method for manufacturing a toner for use in electrophotography comprising the steps of:

melting and kneading binder resin, colorant, electrostatic charge control agent and wax in a kneader to form kneaded matter;

producing toner particles by grinding and classifying the kneaded matter after said kneaded matter has been cooled; and producing a toner having a positive electrostatic charge by mixing and adding to said toner particles an external additive; said additive comprising particles selected from the group consisting of silica, aluminum oxide, and cerium oxide, which are coated with a coating mixture of tin oxide and antimony.

20. The method of claim 19, wherein said coated particles are coated silica particles.

21. The method of claim 19, wherein said coated particles are coated cerium oxide particles.

22. The method of claim 19, wherein said coated particles are coated aluminum oxide particles.

23. A method for manufacturing a toner for use in electrophotography comprising the steps of:

melting and kneading binder resin and a magnetic material in a kneader to produce kneaded matter;

producing magnetic toner particles by grinding and classifying the kneaded matter after said kneaded matter has been cooled; and producing a single component magnetic toner by mixing and adding to said toner particles an external additive, wherein said additive comprises particles selected from the group consisting of silica, aluminum oxide, and cerium oxide, which are coated with a coating mixture of tin oxide and antimony.

24. The method of claim 23, wherein said coated particles are coated silica particles.

25. The method of claim 23, wherein said coated particles are coated cerium oxide particles.

26. The method of claim 23, wherein said coated particles are coated aluminum oxide particles.

* * * * *